US005345645A

United States Patent [19]

Page

[11] Patent Number: 5,345,645

[45] Date of Patent: Sep. 13, 1994

[54] SUBGINGIVAL TOOTHBRUSH

[76] Inventor: Lawrence R. Page, 10361 Sixpence Cir., Columbia, Md. 21044

[21] Appl. No.: 855,584

[22] Filed: Mar. 23, 1992

[51] Int. Cl.[5] ..... A46B 9/04

[52] U.S. Cl. ..... 15/167.1; 15/160; 15/DIG. 5

[58] Field of Search ..... 15/167.1, 160, DIG. 5

[56] References Cited

U.S. PATENT DOCUMENTS

| | | | |
|---|---|---|---|
| 1,770,195 | 7/1930 | Burlew | 15/167.1 |
| 2,244,098 | 6/1941 | Busick | 15/167.1 |
| 2,882,544 | 4/1959 | Hadidian | 15/167.1 |
| 3,129,449 | 4/1964 | Cyzer | 15/167.1 |
| 3,934,298 | 1/1976 | Kim | 15/167.1 |
| 4,679,272 | 7/1987 | Florence | 15/167.1 |

FOREIGN PATENT DOCUMENTS

| | | | |
|---|---|---|---|
| 3116189 | 12/1982 | Fed. Rep. of Germany | 15/167.1 |
| 0443435 | 9/1912 | France | 15/167.1 |
| 0363270 | 12/1931 | United Kingdom | 15/167.1 |
| 0490892 | 8/1938 | United Kingdom | 15/167.1 |

*Primary Examiner*—David A. Scherbel
*Assistant Examiner*—Randall E. Chin
*Attorney, Agent, or Firm*—Morton J. Rosenberg; David I. Klein

[57] ABSTRACT

This invention directs itself to a subgingival toothbrush (10) for insertion of first and second sets of bristles (36 and 38) below the gum line (22) of a user. First and second sets of bristles (36 and 38) are adapted to be oscillated and abrasively contact a tooth surface (20) below the gum line (22) to disrupt bacteria adhering to the tooth surface (20). The first and second sets of bristles (36 and 38) are encapsulated by an encapsulating pair of sleeve members (40 and 42) to provide stabilization of the first and second sets of bristles (36 and 38) when in operational use. In this manner, first and second sets of bristles (36 and 38) can optimally be inserted beneath the gum line (22) of a user (14) for abrasive action against the tooth surface (20) and aid in controlling periodontal disease.

11 Claims, 1 Drawing Sheet

SUBGINGIVAL TOOTHBRUSH

BACKGROUND OF THE INVENTION

1. Field of the Invention

This invention directs itself to toothbrushes for cleansing the tooth roots of a user. In particular, the subject invention relates to a subgingival toothbrush for disrupting bacteria under the gum line of a user's tooth. In particular, this invention directs itself to a subgingival toothbrush for insertion under the gum and between the teeth of a user for applying abrasive forces to bacteria adhered to a user's tooth below the gum line. Still further, this invention relates to a subgingival toothbrush which includes a first and second set of bristles longitudinally aligned to each other and mounted on a base section of the toothbrush handle. Still further, the subgingival toothbrush includes the first and second sets of bristles extending to a length approximating 16.0 mm above the base section of the handle member to allow for insertion and abrasive action deep into periodontal pockets beneath the gum line of the user, Additionally, this invention directs itself to a subgingival toothbrush which includes longitudinally aligned and adjacently located first and second sets of bristles having end sections with inclined envelopes to allow ease of insertion beneath the gum line of a user. Further, this invention relates to a subgingival toothbrush including sleeve members surrounding the first and second sets of bristles and extending throughout a predetermined length of the bristles to provide a stabilizing effect for the bristles when force loads are applied.

2. Prior Art

Toothbrushes are well known in the art. However, most toothbrushes are used for control of supragingival and marginal bacterial plaque. Such prior art toothbrush systems do not provide for the elements which allow insertion and optimized disruption of bacteria below the gum line of a user.

Optimized periodontal infection control is temporarily provided by scaling and root planing however, such cannot be done daily in the privacy of one's home as part of a patient's treatment plan. Ultrasonic instruments have been used to provide subgingival cleansing however, as in the case of scaling and root planing, such must be provided by an expert in the use of such instruments and cannot be accomplished by the patient as part of a home treatment plan on a routine basis as needed since destructive bacterial growth will recur quickly.

Ordinary or traditional brushing may well control supragingival and marginal bacterial plaque however, such does not address the problem of insertion of the toothbrush below the gum line where gum diseases occur. In standard well known toothbrush combinations, the plurality of sets of bristles extend over a wide area of the toothbrush and are not adaptable for insertion between the tooth and the gum line into periodontal pockets which is necessary in any subgingival control program.

Other techniques such as flossing also provide for control of supragingival and marginal bacterial plaque however, such flossing does not allow for subgingival insertion and abrasive contact with bacteria more than 2–3 mm under the user's gum line, and not even that where concave root surfaces exist.

In some prior art massaging devices, a handle member includes a rubber tip extending therefrom which may be inserted between the teeth to massage the gums of the user but is not insertable deep into periodontal pockets. However, such tips do not provide for the abrasive action of a subgingival toothbrush necessary to remove and disrupt bacteria beneath the gum line of a user.

The best prior art known to the Applicant includes U.S. Pat. Nos. 5,040,260; 3,110,918; 2,882,544; 4,654,922; 5,000,684; 1,370,343; 1,693,384; 4,882,803; 4,679,272; 4,471,505; 4,263,691; and, 3,677,264.

Prior art systems such as that shown in U.S. Pat. No. 5,040,260 direct themselves to tooth cleaning and polishing systems for cleansing and polishing teeth and massaging and stimulating the gums. However, such prior art systems extend throughout a large cross-sectional area and are not adaptable for insertion between the gum line and a tooth for abrasive contacting of teeth below the gum line for disruption of bacteria adhered to the tooth.

SUMMARY OF THE INVENTION

A subgingival toothbrush is provided which includes a handle member extending in a longitudinal direction with the handle member having both a gripping section and a base section. There is provided at least a first set of bristles secured to the base section of the handle member with the bristles extending in a substantially vertical direction throughout a predetermined length. Additionally, a bristle encapsulation mechanism is provided in the form of sleeve members for supporting the first set of bristles. The bristle encapsulation mechanism is also vertically directed and fixedly secured to the base section of the handle member for continuously surrounding the first set of bristles throughout a predetermined portion of the first set of bristles a predetermined length extending above the base section of the handle member.

DESCRIPTION OF THE PREFERRED EMBODIMENTS

Figure 1:
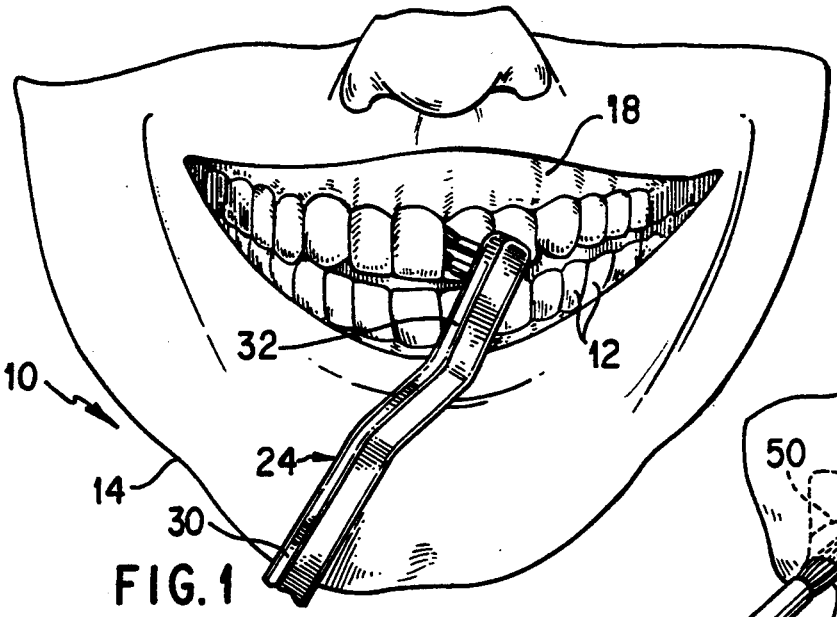
FIG. 1 is an elevational view of the subject subgingival toothbrush during operation by a user.
Figure 6:
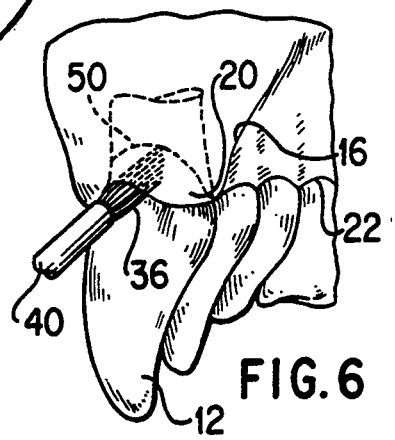

Referring now to FIGS. 1–6, there is shown subgingival toothbrush 10 particularly adapted to be inserted between teeth 12 of user 14 for use within gum pockets 16 depicted in FIG. 6. In general, subgingival toothbrush 10 is adapted for insertion between teeth 12 of user 14 and for positional placement under the user's gum 18. Once inserted below gum line 22, as will be seen in following paragraphs, subgingival toothbrush 10 is contiguously interfaced with tooth surface 20 beneath gum line 22 to provide an abrasive interface when displaced in an oscillating manner to disrupt bacteria and other waste materials contained on tooth surface 20.

In this manner, subgingival toothbrush 10 provides for a cleansing of tooth surface 20 below gum line 22 wherein bacterial ecosystems growing on tooth surface 20 may be dislodged from tooth surface 20 and removed from root or tooth surface 20 to minimize periodontal disease progression.

Destructive periodontal disease is directly related to subgingival overgrowth of specific genera of oral bacteria. Subgingival toothbrush 10 has been found to be effective in disrupting and removing various bacterial species that are associated with periodontitis including but not limited to black-pigmented Bacteroides and Porphyromonas species. Such organisms are found in the general population however such species generally increase with the onset of periodontal diseases. The overgrowth of destructive bacterial species is a response to the subgingival environment, which is a reflection of the specific host defenses in combination with local artatomic variations such as complex root contours or tilting of the teeth 12.

Figure 2:
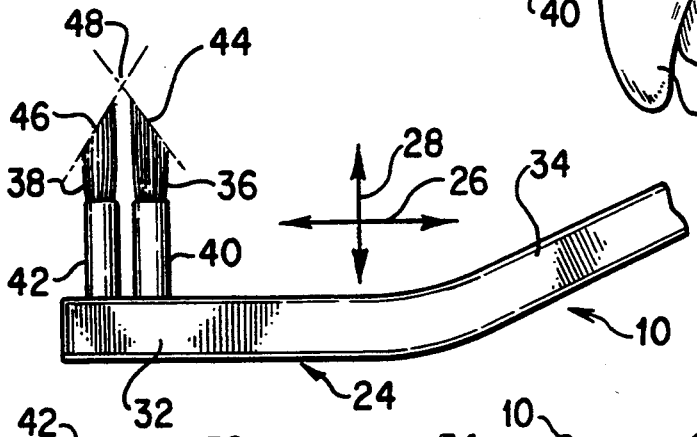
FIG. 2 is an elevational view of the subgingival toothbrush showing the base section having first and second sets of bristles extending therefrom.

Referring now to FIGS. 1–4 and 6, there is shown subgingival toothbrush 10 having handle member 24 extending generally in a longitudinal direction defined by longitudinal direction arrow 26 shown in FIG. 2. Handle member 24 includes both gripping section 30 and base section 32 as shown. Gripping section 30 is used for gripping of subgingival toothbrush 10 by user 14. Additionally, in the embodiment shown in FIGS. 1–4, intermediate handle section 34 joins gripping section 30 and base section 32 wherein base section 32 and gripping section 30 are non-planar. In this manner there is provided a contoured subgingival toothbrush 10 which in some cases may provide for ease of entrance into gum pockets 16 by subgingival toothbrush 10.

Handle member 24 may be formed of a plastic composition not important to the invention concept as herein described with the exception that such plastic composition have sufficient structural integrity to accept the force loading applied by user 14 when subgingival toothbrush 10 is operationally activated. Handle member 24 may be formed of a standard thermoplastic material composition and formed in one piece formation whether handle member 24 is substantially planar as shown in FIG. 5 or multi-planar as shown in FIGS. 1–4. In some cases, the angular relation and coupling of intermediate handle section 34 on opposing ends respectively to base section 32 and gripping section 30 of handle member 24 provides user 14 with a somewhat easier positional entrance motion for certain tooth interfaces of user 14 however, in other areas of the mouth of user 14 the embodiment shown in FIG. 5 having a planar handle member 24 is of sufficiently optimized contouring to provide substantially the same disruption of bacteria as that of the embodiment shown in FIGS. 1–4.

Subgingival toothbrush 10 includes first set of bristles 36 extending substantially in a vertical direction as depicted by vertical direction arrow 28 in FIG. 2. First set of bristles 36 may be formed of nylon which is a generally commercially accepted standard nylon bristle used in prior art toothbrushes. The diameter of each bristle is approximately 0.008 inches in diameter. First set of bristles 36 is fixedly secured to base section 32 of handle member 24 in a standard manner such as molding or some other type of fixed securement not important to the inventive concept as herein described. First set of bristles 36 extends in vertical direction 28 and includes a total extension approximating 16 mm in vertical direction 28 above base section 32 of handle member 24.

Additionally, second set of bristles 38 formed of substantially the same material as first set of bristles 36 is fixedly secured to base section 32 as is shown in FIGS. 2–5. Second set of bristles 38 extend in vertical direction 28 to a vertical length substantially identical to the vertical length of first set of bristles 36. Thus, second set of bristles 38 extend above an upper surface of base section 32 to a predetermined length approximating 16 mm.

The extended vertical length of both first and second sets of bristles 36 and 38 is important to the overall concept of subgingival toothbrush 10. Ordinary toothbrushes provide bristles which have an extended length substantially less than 16 mm as provided in subgingival toothbrush 10 herein described. It is to be understood that subgingival toothbrush 10 of the subject invention is to be inserted beneath gum line 22 for abrasive or other contiguous interface contact with tooth surface 20 within gum pockets 16. It has been found that gum pockets 16 may be of an extended length and depth approximating in some cases 8–12 mm beneath gum line 22. Thus, in order to allow insertion of first and second sets of bristles 36 and 38, the overall extended length of first and second sets of bristles 36 and 38 must be significantly greater than that known in standard toothbrush prior art systems.

However, the extended length of first and second sets of bristles 36 and 38 provides for a cantilever support with respect to handle member 24. It must be remembered that bristle sets 36 and 38 are resilient in compositional quality and thus are subject to deflection upon interface with tooth surface 20 beneath gum line 22. As the extension of bristle sets 36 and 38 is lengthened, the deflection and spreading out of the end portions of bristle sets 36 and 38 increases and may not provide for sufficient abrasive force to be applied to tooth surface 20 for disruption of adhered bacteria.

Figure 4:
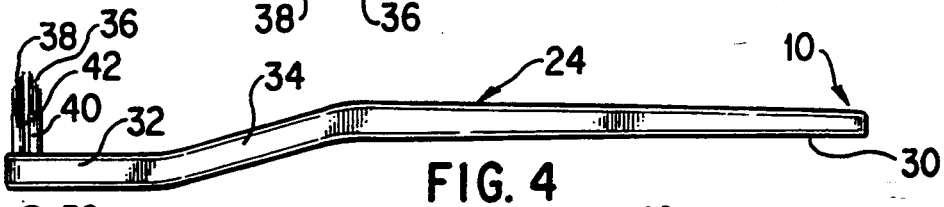
FIG. 4 is an elevational view of the subject subgingival toothbrush showing the handle member having non-planar base and gripping sections.
Figure 5:
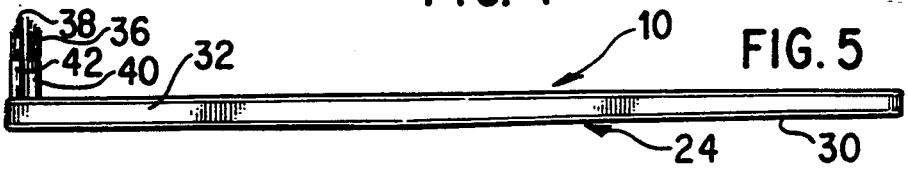
FIG. 5 is an embodiment of the subgingival toothbrush of the subject invention showing the handle member of the subgingival toothbrush being planar in contour throughout its extended longitudinal length; and, FIG. 6 is a schematic representation of a user's tooth showing periodontal pockets and the action of the subgingival toothbrush on a tooth surface below the gum line.

In order to provide stabilization for first and second sets of bristles 36 and 38 there is provided first and second bristle encapsulation mechanisms 40 and 42 shown clearly in FIGS. 2, 4 and 5. First and second bristle encapsulation mechanisms 40 and 42 extend in vertical direction 28 and are secured to base section 32 of handle member 24 as shown. First and second bristle encapsulation mechanisms 40 and 42 may be sleeve members extending throughout a predetermined vertical length direction and continuously surround first and second sets of bristles 36 and 38 respectively to provide a support for each set of bristles 36 and 38 during operational use.

Sleeve members 40 and 42 may be formed of a plastic composition material similar to that forming handle member 24. Each of sleeve members 40 and 42 extend approximately 8.0 mm above the upper surface of base section 32. In this manner, sleeve members 40 and 42 extend approximately one half the total elongated vertical extension of first and second sets of bristles 36 and 38 above base section 32.

First and second bristle encapsulation mechanisms or sleeve members 40 and 42 may be formed in one piece formation with handle member 24 through molding or some like technique or otherwise fixedly secured to base section 32. The overall functionality of sleeve members 40 and 42 is to provide an insert capability of first and second sets of bristles 36 and 38 within and throughout the extended vertical direction of sleeve members 40 and 42 to provide a stabilizing support force interacting system when subgingival toothbrush 10 is operationally used on tooth surface 20.

Figure 3:
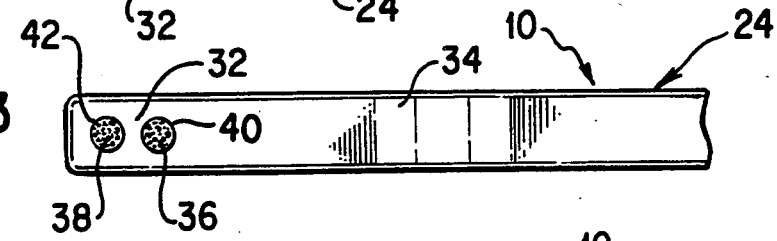
FIG. 3 is a plan view of the subgingival toothbrush as provided in FIG. 2.

As can be clearly seen in FIG. 3, first and second sleeve members 40 and 42 are substantially longitudinally aligned each with respect to the other. The sleeve members 40 and 42 are positionally located in longitudinal alignment and are adjacently positioned each with respect to the other. As can be seen, first and second sleeve members 40 and 42 are displaced each from the other by a distance which is small enough to allow insertion of first and second sets of bristles 36 and 38 between teeth 12. The displacement distance may be as great as 1.0 mm and in some cases, sleeve members 40 and 42 may be positionally aligned in a manner such that their outer surfaces are substantially in contiguous contact.

As seen in FIG. 2, the end sections of each of first and second sets of bristles 36 and 38 define first and second bristle inclined envelopes 44 and 46 respectively. Envelopes 44 and 46 define apex 48 centrally located between first and second sets of bristles 36 and 38. The particular height of apex 48 is a function of the longitudinal displacement of first and second sets of bristles 36 and 38 and when such bristles are adjacent and contiguous each to the other, apex 48 defines an uppermost position or point of the end bristles for each of sets 36 and 38.

The inclined envelopes 44 and 46 are important in that such provides for a larger surface area for abrasive contact when bristles 36 or 38 are forcibly inserted against tooth surface 20. In this manner, larger areas of bacteria may be disrupted from tooth surface 20 below gum line 22 when subgingival toothbrush 10 is in operation. Additionally, the inclined geometry as provided by envelopes 44 and 46 allows insert of bristle sets 36 and 38 in a simpler manner when a narrow pocket 16 is provided between the gum and tooth 12. The tips of bristle sets 36 and 38 initially will displace the edge of the user's gum and allow the remaining portion of bristle sets 36 and 38 to be inserted in a simpler and easier manner when taken with respect to a brush having bristles with a blunt area which impinge all at the same time on the edge of the opening of a thin pocket 16. Thus, the inclined envelopes 44 and 46 provide for ease of insert within pocket 16 against surface 20 of teeth 12 which is generally not an important criteria for standard toothbrushes not used for subgingival operation.

The extended length of first and second sets of bristles 36 and 38 allows insertion and abrasive disruption of adhered bacteria to tooth surface 20. It is to be understood that first and second sleeve members 40 and 42 are formed of a thin-walled plastic perhaps having a thickness approximating 0.1 mm in thickness which allows for deeper insertion of first and second sets of bristles 36 and 38 within pocket 16. It is to be understood that first and second sleeve members 40 and 42 may be inserted to gum line 22 or perhaps where deep pockets 16 exist, to an additional distance within pocket 16.

In use, subgingival toothbrush 10 is grasped by a user's hand (not shown) through handle member and in particular in gripping section 30. First and second sets of bristles 36 and 38 are inclined with respect to tooth 12 and are inserted at substantially a 45 degree angle between consecutively located teeth 12. Bristles 36 and 38 enter pocket 16 and may be moved to gum attachment line 50 where there is the attachment of the gum to the root surface of tooth 12. First and second sets of bristles 36 and 38 are oscillated against surface 20 to disrupt bacteria. In this manner, dislodgement of bacteria provides for an efficient periodontal disease procedure easily done by the user in the privacy of his or her home.

The particular inclining of envelopes 44 and 46 as shown in FIG. 2 allows for the user to insert first and second sets of bristles 36 and 38 between adjacently located teeth 12 and apply an abrasive oscillatory motion to respective surfaces 20 of adjacent teeth 12 during one oscillatory operation. In this manner, the overall disruption and cleansing process is optimized.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A subgingival toothbrush comprising:

(a) a handle member extending in a longitudinal direction, said handle member having a gripping section and a base section forming a substantially planar upper surface;

(b) only first and second longitudinally aligned bristle tufts fixedly secured to said base section of said handle member, each of said first and second tufts extending in a substantially normal direction with respect to said substantially planar upper surface and having a predetermined length approximately 16.0 mm above said base section upper surface, each first and second tuft having a substantially linearly inclined upper surface envelope forming an envelope apex therebetween for subgingival penetration by said first and second tufts; and, (c) a first and second bristle encapsulation means for respectively supporting said first and second tufts, said first and second bristle encapsulation means being normally directed to said base section upper surface and fixedly secured to said base section for continuously surrounding said first and second tufts throughout a predetermined length above said base section.

2. The subgingival toothbrush as recited in claim 1 where said first and second bristle encapsulation means include first and second sleeve members surrounding and supporting said first and second tufts respectively.

3. The subgingival toothbrush as recited in claim 2 where said first and second sleeve members are substantially longitudinally aligned each with respect to the other.

4. The subgingival toothbrush as recited in claim 2 where said first and second sleeve members are substantially longitudinally aligned and adjacently located each with respect to the other.

5. The subgingival toothbrush as recited in claim 2 where said first and second sleeve members are longitudinally aligned and displaced each from the other by a predetermined distance.

6. The subgingival toothbrush as recited in claim 5 where said first and second sleeve members are displaced each from the other by a distance approximately 1.0 mm.

7. The subgingival toothbrush as recited in claim 2 where said first and second sleeve members are formed of a plastic material composition.

8. The subgingival toothbrush as recited in claim 2 where said first and second sleeve members have an extended length extending above said base section approximately 8.0 mm.

9. The subgingival toothbrush as recited in claim 2 where said first and second tufts are formed of a nylon composition.

10. The subgingival toothbrush as recited in claim 2 where said gripping section and said base section of said handle member are substantially planar.

11. The subgingival toothbrush as recited in claim 2 where said gripping section and said base section of said handle member are substantially out of plane each with respect to the other.

* * * * *